US006578937B1

(12) United States Patent
Thoman

(10) Patent No.: US 6,578,937 B1
(45) Date of Patent: Jun. 17, 2003

(54) STACKING TOOLBOX

(76) Inventor: Fred Thoman, 3921 E. 65th Ave., Anchorage, AK (US) 99507

( * ) Notice: Subject to any disclaimer, the term of this patent is extended or adjusted under 35 U.S.C. 154(b) by 112 days.

(21) Appl. No.: 09/971,996

(22) Filed: Oct. 4, 2001

Related U.S. Application Data

(60) Provisional application No. 60/238,198, filed on Oct. 4, 2000.

(51) Int. Cl.[7] ..... A47B 87/02

(52) U.S. Cl. ..... 312/107; 312/240; 312/902; 220/23.83; 206/511; 206/373

(58) Field of Search ..... 312/107, 108, 312/111, 205, 198, 200, 201, 237, 240, 244, 257.1, 294, 298, 299, 301, 350, 902; 206/372, 373, 349, 499, 505, 509, 511; 220/4.26, 4.27, 23.83, 23.86

(56) References Cited

U.S. PATENT DOCUMENTS

| | | | | | |
|---|---|---|---|---|---|
| 3,556,623 | A | * | 1/1971 | Damijonaitis | 312/237 X |
| 3,762,788 | A | * | 10/1973 | Heller | 312/240 |
| 4,084,865 | A | * | 4/1978 | Joyce | 312/111 |
| 4,240,684 | A | * | 12/1980 | Henning | 312/111 |
| 4,294,348 | A | * | 10/1981 | Hastings | 206/373 X |
| 4,303,158 | A | * | 12/1981 | Perkins | 206/373 |
| 4,390,217 | A | * | 6/1983 | Wagner | 312/205 |
| 4,460,085 | A | * | 7/1984 | Jantzen | 206/373 X |
| 4,550,828 | A | * | 11/1985 | Baldwin et al. | 206/373 X |
| 5,011,013 | A | * | 4/1991 | Meisner et al. | 206/373 |
| 5,016,946 | A | * | 5/1991 | Reznikov et al. | 312/108 |
| 5,186,479 | A | * | 2/1993 | Flowers | 280/47.35 |
| 5,437,502 | A | * | 8/1995 | Warnick et al. | 312/244 |
| 5,441,163 | A | * | 8/1995 | Carrasco | 220/23.86 |
| 5,540,329 | A | * | 7/1996 | Vogeley | 206/373 |
| D382,113 | S | * | 8/1997 | DuRapau | D3/274 |
| 5,669,498 | A | * | 9/1997 | Fierek et al. | 206/373 |
| 5,704,483 | A | * | 1/1998 | Groh | 206/511 |
| 5,833,333 | A | * | 11/1998 | Brown | 312/235.1 |
| 5,873,463 | A | * | 2/1999 | Purcell | 206/372 |
| 5,918,751 | A | * | 7/1999 | Kelly | 211/194 |

FOREIGN PATENT DOCUMENTS

| | | | | |
|---|---|---|---|---|
| GB | 406789 | * | 3/1934 | 312/240 |

* cited by examiner

*Primary Examiner*—James O. Hansen
(74) *Attorney, Agent, or Firm*—Michael Tavella

(57) ABSTRACT

A toolbox that has an outer housing, an inner housing and a number of storage trays. The outer housing is removable from the inner housing. To use the toolbox, the outer housing is removed and placed on top of the inner housing. Then, alternate drawers are removed from the inner housing and placed in the upper housing. This creates a number of drawers that have spaces between them. The spaces are large enough to see into the drawers and to reach in and obtain tools. Once the tools have been positioned, they are readily accessible for use. When the job is done, the drawers are returned to the inner housing, the outer housing is removed and fitted over the inner housing for storage. Once locked into place, the complete toolbox can then be transported as desired.

20 Claims, 16 Drawing Sheets

STACKING TOOLBOX

CROSS REFERENCE TO RELATED APPLICATIONS

This application claims the benefit of provisional application Ser. No. 60/238,198 filed Oct. 4, 2000.

STATEMENT REGARDING FEDERALLY SPONSORED RESEARCH AND DEVELOPMENT

Not Applicable

BACKGROUND OF THE INVENTION

1. Field of the Invention

This invention relates to portable stacking toolboxes and particularly to stacking toolboxes with removable, stackable drawers.

2. Description of the Prior Art

Portable toolboxes have existed since the earliest times that workers have had to carry tools. In the past, these have been simple, open boxes that have a handle. Overtime, these boxes became more elaborate with drawers, storage bins, peg boards, organizers and other features that make keeping and storing tools easier. Some examples of these types of toolboxes are found in the following U.S. Patents. U.S. Pat. No. 4,084,865 teaches a box that has either removable trays or a set of storage bins to hold and organize tools. U.S. Pat. No. 4,240,684 teaches a set of nested pyramidal shapes that have pegboards to hold a variety of tools and supplies. In use, the boxes can be opened to access the tools and for storage, the boxes can be nested together as secured.

U.S. Pat. Nos. 5,873,463, 4,460,085, 4,390,217, 4,294, 348, and 4,303,158 disclose boxes that have hinged doors and lids that open to reveal storage compartments inside.

U.S. Pat. Nos. 4,550,828, 5,437,502, 5,833,333, and U.S. Pat. No. Des. D382,113 all disclose toolboxes that have removable lids that can be used a seats or stools. When the lids are removed, the interior tool storage is revealed, setting up the tools for use. U.S. Pat. No. 5,437,502 has a set of removable drawers installed that hold tools. This device is intended for use with ladders and the drawers are designed to hang over ladder rungs.

In another line of patents, stacking type tool and storage boxes can be found. For example, U.S. Pat. No. 5,186,479 teaches a cart that has storage shelves. U.S. Pat. Nos. 5,918,751 and 5,704,483 teach stacking type trays that can carry various items. Finally, U.S. Pat. No. Nos. 5,011,013, 5,441,163, 5,540,329, and 5,669,498, teach storage containers, such as buckets, that have stacked storage trays within them. These trays can hold tools and other supplies and can be removed from the bucket as needed.

BRIEF DESCRIPTION OF THE INVENTION

Although all of these designs have merit, they also have problems. One major problem is that to use the tools, the trays must be spread over a large area for use. Not only does this take up a lot of space; it sometimes makes it difficult to get a desired tool. If the tool is at the bottom of the stack, the entire stack must be removed to get it. The instant invention eliminates the need to spread tools over a large area or to have to dig through stacks of tools to find the one that is needed at that time. The instant invention is a toolbox that has an outer housing, an inner housing and a number of storage drawers. The outer housing is removable from the inner housing. To use the toolbox, the outer housing is removed and placed on top of the inner housing. Then, alternate drawers are removed from the inner housing and placed in the upper housing. This creates a number of drawers that have spaces between them. The spaces are large enough to see into the drawers and to reach in and obtain tools. The set up is fast. Once the tools have been positioned, they are readily accessible for use. Moreover, they do not take up any more floor space that the area occupied by the toolbox itself. When the job is done, the drawers are returned to the inner housing, the outer housing is removed and fitted over the inner housing for storage. Once the outer housing is locked into place, the complete toolbox can then be transported as desired.

This design has a number of different forms, which are illustrated in the accompanying embodiments as described below:

DETAILED DESCRIPTION OF THE INVENTION

Figure 1:
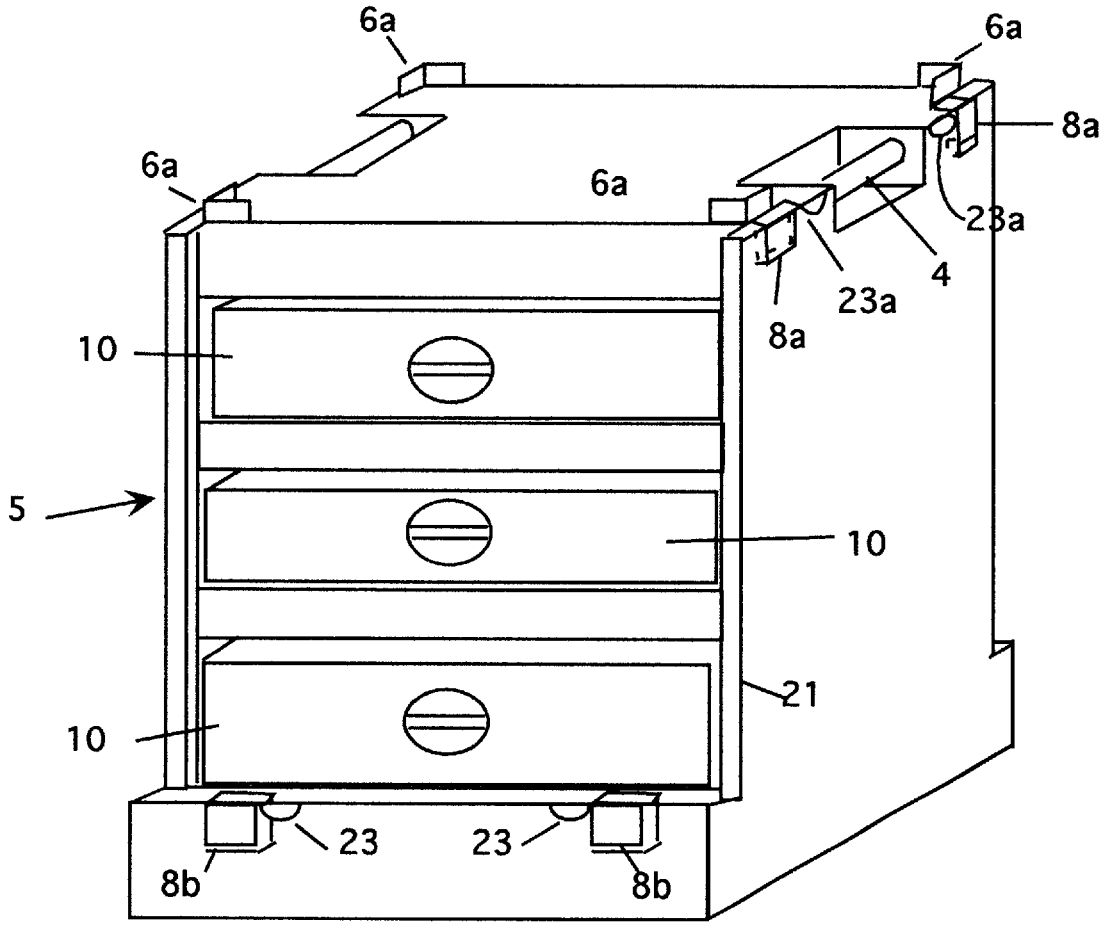
FIG. 1 shows a perspective view of the outer housing of the basic design, called the "regular" unit
Figure 2:
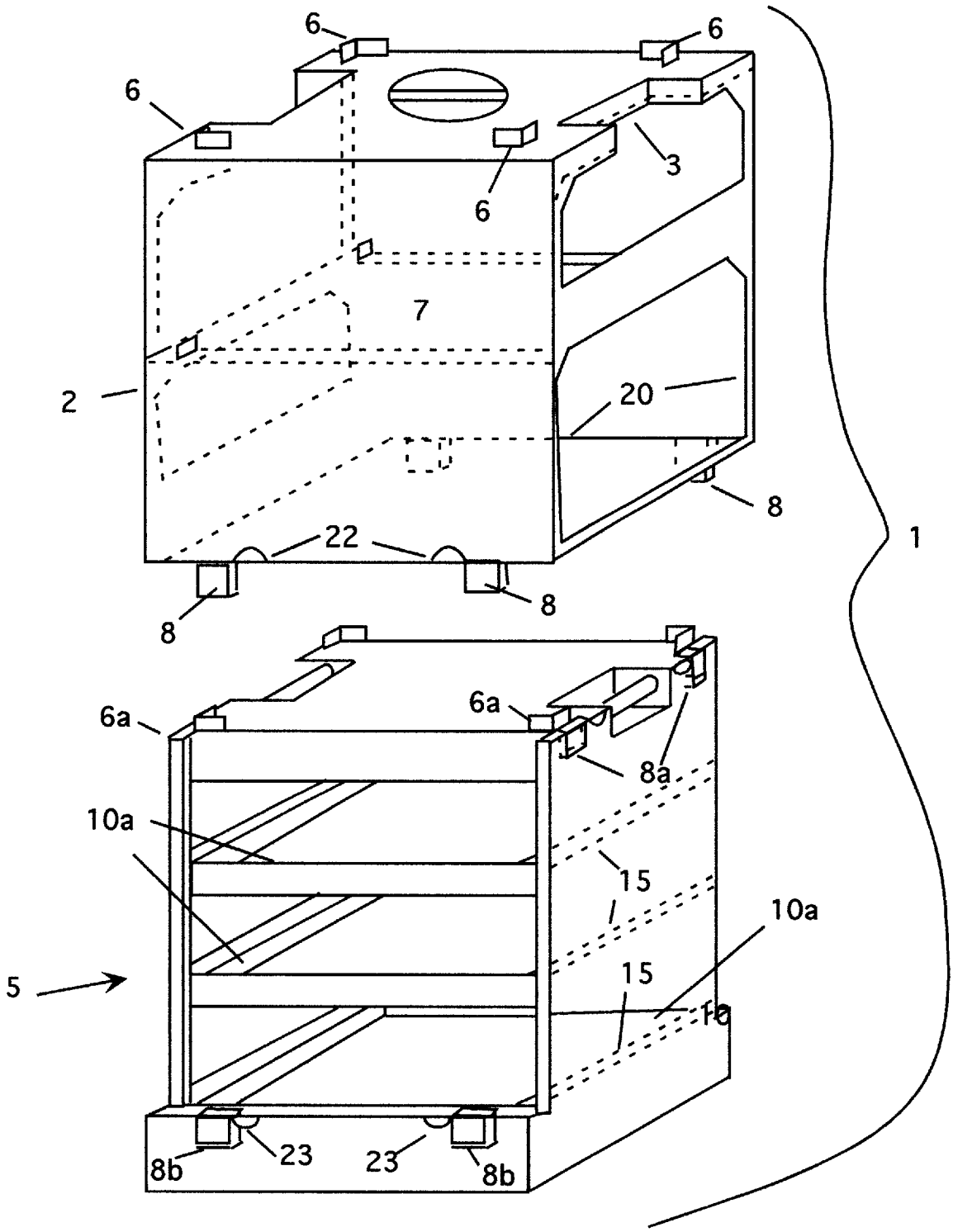
FIG. 2 shows a perspective view of the regular unit opened
Figure 3:
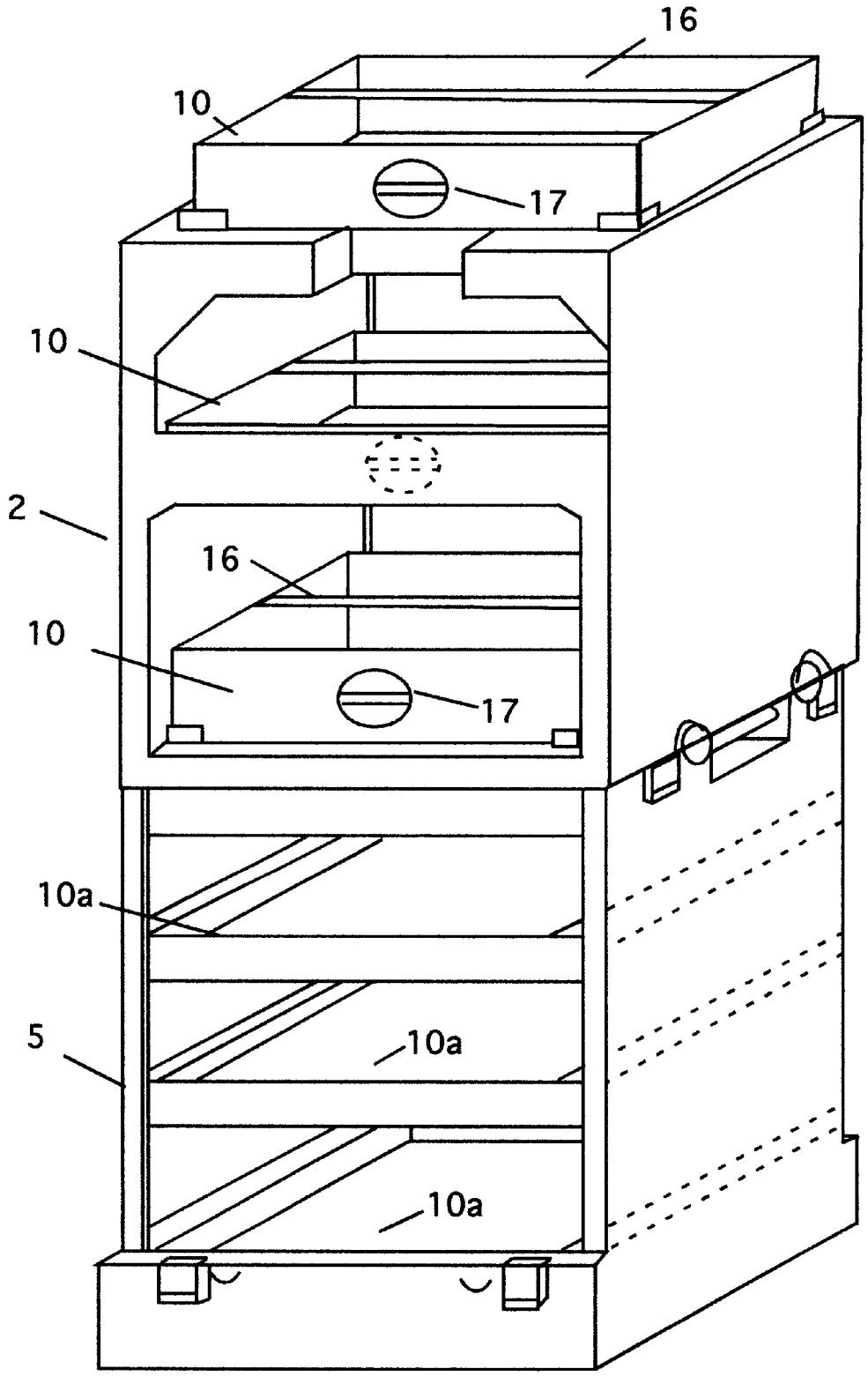
FIG. 3 is a perspective view of the regular unit with the top rotated and secured to the base.

Referring now to FIGS. 1, 2, and 3, FIG. 1 shows the inner case of the "regular" unit 1 with the trays installed.

As shown in the figures, the outer housing 2 has a handle center depression 3 to accommodate the handles 4 that are attached to the inner unit 5. When the units are combined, the handles can be used to lift the toolbox.

At the top of the outer housing 2 are four corners 6 that hold one of the removable trays 10, described below, when the box is on the open position. Note that the word trays and drawers in this specification are intended to be interchangeable.

The outer housing also has a set of rails 7 that are used to support the bottom of a second removable tray 10 when the box is in the open position.

At the bottom of the outer housing are four pegs 8 that fit in sockets 8*a* in the top and sockets 8*b* in bottom of the inner case.

FIG. 2 shows the inner case 5 with the outer case lifted off. This is the first stage of assembling the toolbox. The inner case 5 holds six trays that can hold tools and other supplies. Three of the six trays are removable. These trays are designated with the reference numeral 10. Three of the trays are fixed. These are designated with the numeral 10*a*. In the preferred embodiment, the removable trays are different sizes. However, the exact sizes and dimension of the trays and openings is a matter of choice.

The outer housing 2 is designed with a ½" overhanging lip 20 to protect the unit from the weather. This lip fits over a vertical rim 21 (see FIG. 2) that is formed in all four corners of inner housing 5 to weather proof the unit when it is in the closed position.

The inner housing 5 has a set of parallel rails 15 that are support rails for the removable trays 10. These trays sit on these rails when the unit is closed.

As shown in FIG. 3, each of the removable trays 10 has a handle 16 across the top for lifting the tray. Each removable tray also has a front handle 17. In the preferred embodiment, this handle is a front-depression used for finger hold to grip the handle to remove the tray.

Each removable drawer can also has a pair of stops (not shown) on the bottom of the tray to guide the tray between the rails 15. These stops also keep the tray from sliding out of the front or back of the box. These stops are common to the art.

To secure the unit when closed and opened, buckles are used. Reference numeral 22 indicates the top half of the buckles, which are recessed in the bottom wall of the outer housing as shown. Numeral 23 indicates the bottom half of the buckles as shown in FIG. 2. Two pairs of buckles bottom 23 are located at the bottom front of the inner housing see e.g., FIG. 1. Two additional pairs of buckle bottoms 23*a* are located on the top sides of the inner housing 5 as shown in FIG. 3. These buckles are used to secure the outer housing to the inner housing in the open position, while the buckle bottoms located on the front bottom of the outer housing are used for when the box is closed.

As shown in FIG. 2, four corners 6*a* are also mounted to the top of the inner housing 5 as shown in FIG. 2. These are used when the unit is opened.

As shown in FIGS. 1, 2 and 3, to open unit, follow the following procedure:

1. Unlock the buckles 22 and 23 that hold the outer housing to the bottom of the inner case.
2. Slide the outer housing up and off the inner case. This is the view shown in FIG. 2.
3. Rotate the outer housing 90 degrees.
4. Place the bottom of the outer housing on top of the inner case.
5. Lock the buckles 22 and 23*a* between the bottom of the outer housing and the top of the inner case.
6. Slide out two of the removable trays 10 and place them in their respective positions in the outer housing (one on the top of the inner housing, one on rails 7).
7. Remove the last tray 10 and place it on top of the outer housing.

This is now the configuration shown in FIG. 3.

The tools are now accessible in both the removable trays and the fixed trays. The added height of the toolbox makes finding, removing and replacing tools easy and fast.

To pack the unit for storage, reverse the steps described above.

This is the structure of the basic unit. Below are several embodiment that modify the structure somewhat, but still create a basic stacked tool box as described above. These variations are described below.

Rack Unit

The second embodiment is a modification that is a rack unit.

Figure 4:
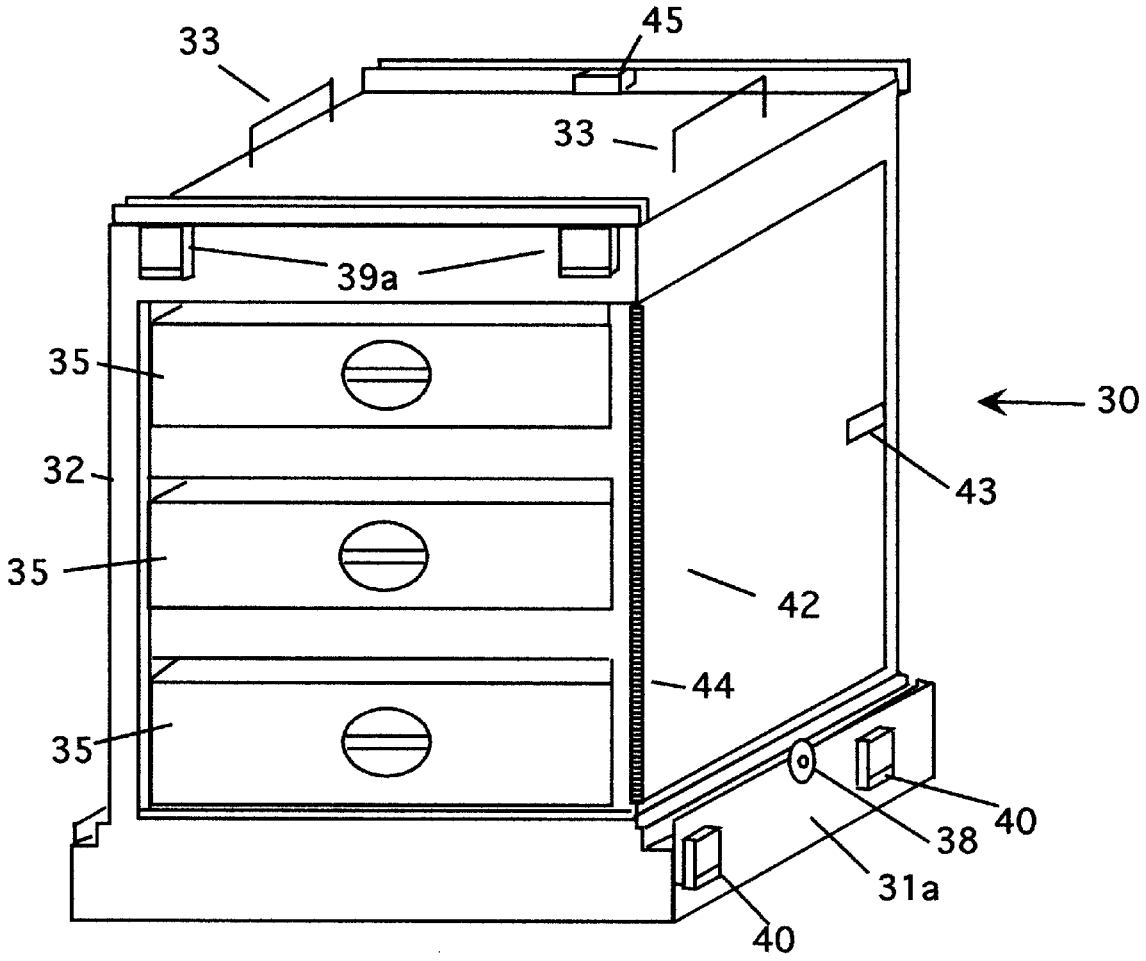
FIG. 4 shows a perspective view of the outer housing of the design, called the rack unit.
Figure 5:
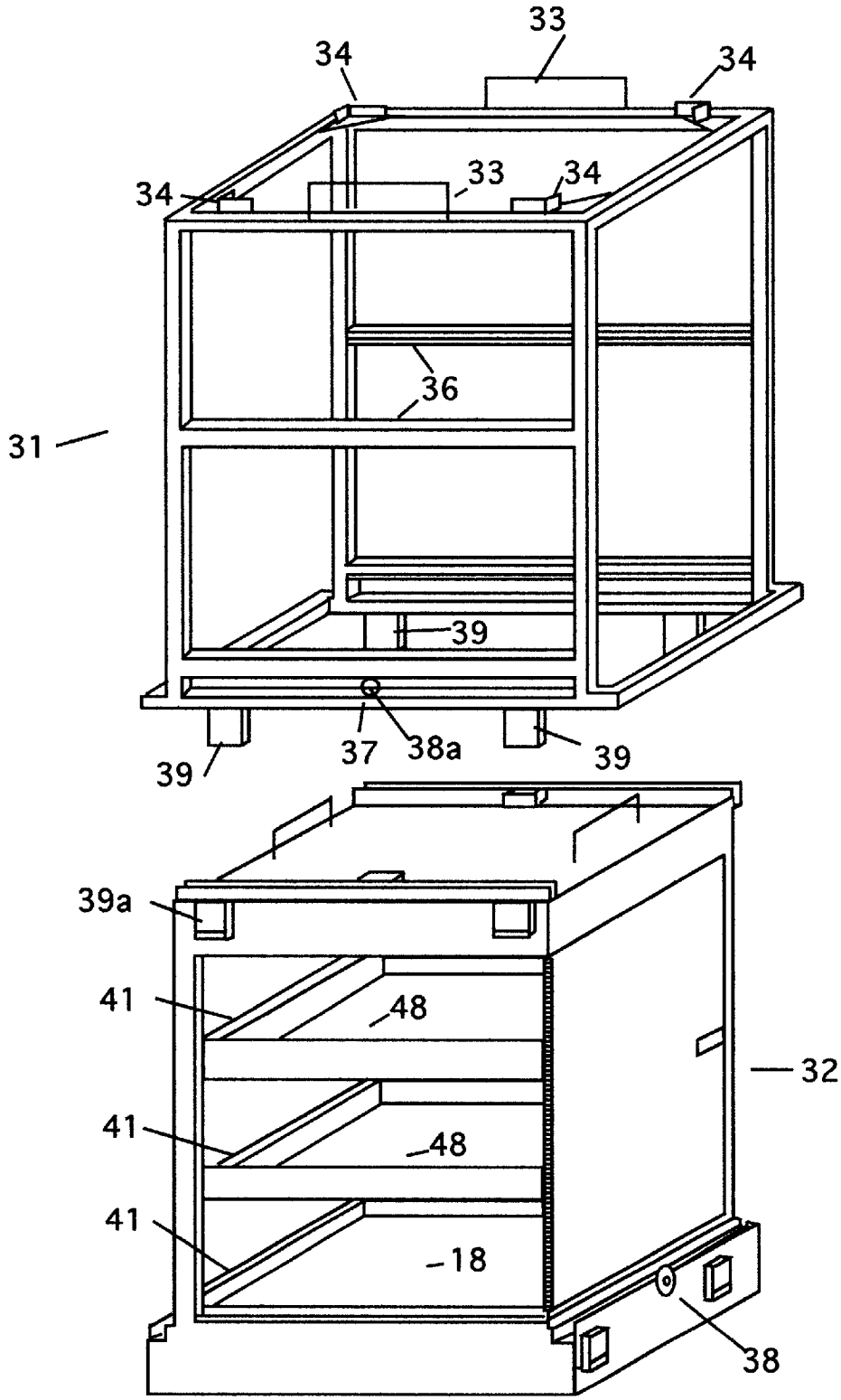
FIG. 5 shows a perspective view of the rack unit opened
Figure 6:
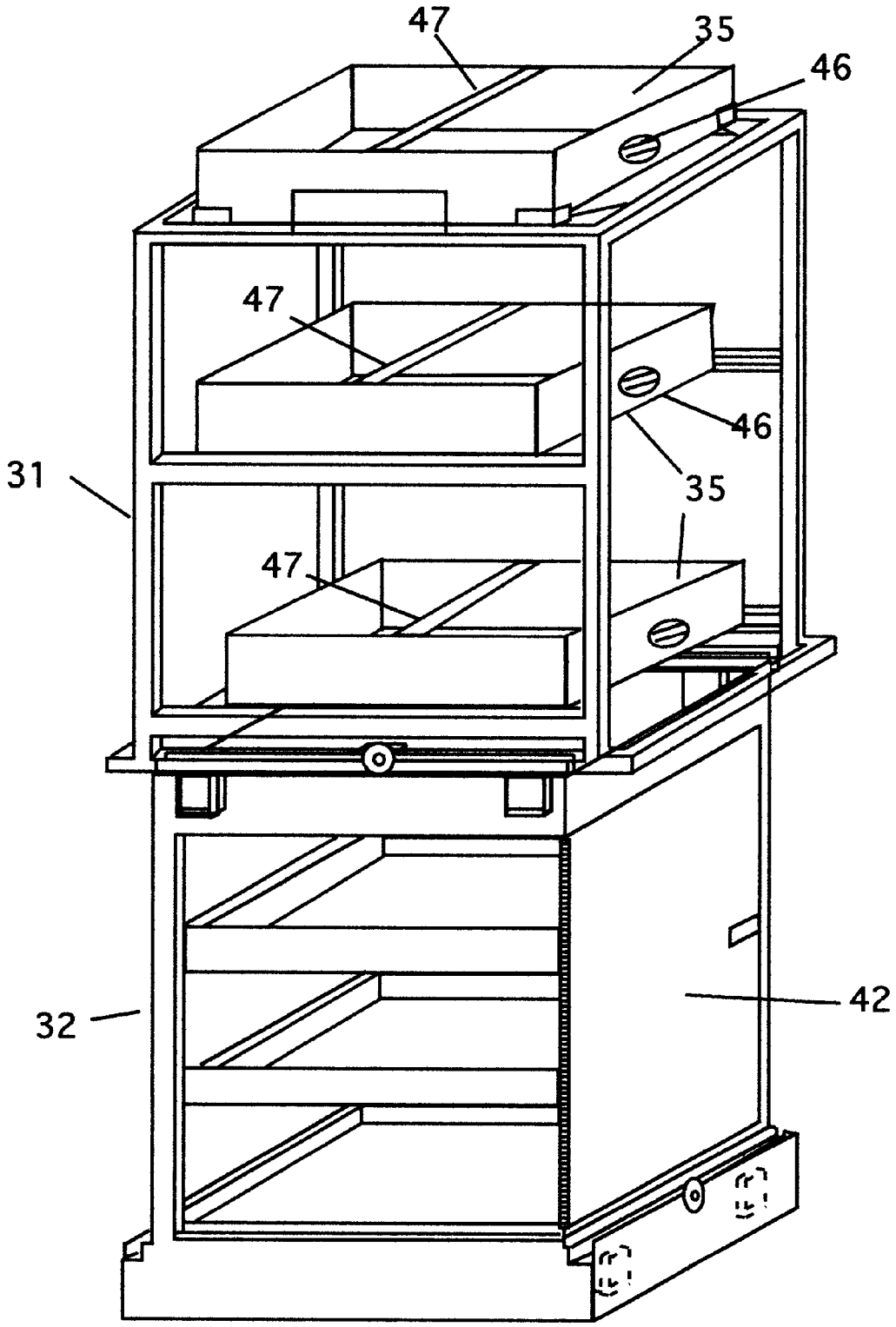
FIG. 6 is a perspective view of the rack unit with the top rotated and secured to the base, ready for use.

The rack unit 30 is shown in FIGS. 4, 5, and 6.

FIG. 4 shows the rack unit closed for storage. FIG. 5 shows the outer housing 31 of this unit lifted off the inner housing 32. As shown, it differs from the first embodiment in that it has no closed sides. At the top of the unit are two handles 33. At the top of the rack are also corners 34 that hold the bottom of one of the removable trays 35 when the unit is in the open position. Note that in this figure, the outer housing is rotated 90 degrees from bottom housing. This is the open position. For storage, the outer housing is rotated 90 degrees back, to align with the lower housing, as discussed below.

The outer housing has and rails 36 that support the bottom of two of the removable trays 35 when in the open position. Note that the trays 35 are rotated 90 degrees from the closed position (FIG. 4) when this device is set up (FIG. 6).

At the bottom of the outer housing is a hole 37 for a safety bolt 38 that secures the outer housing to the lower unit. A fixed nut 38*a* is used to secure the safety bolt.

At the bottom of the outer housing 31 are also pegs 39 that fit into sockets 39*a* (FIGS. 5 and 6) when the device is in the open position for stabilization.

The inner case 32 has identical front and back pieces. Note that the sidepieces are identical as well.

The sides 31*a* of the inner case have sockets 40 to secure pegs from the outer housing when the unit is in the closed position. Note that these sockets have small drain holes in their bottoms (not shown).

The inside of the inner case has a set of rails 41 that hold the movable bottom tray 35 when it is in the closed position.

A door 42 is recessed into the side for the outer housing rack clearance.

The door 42 has a flush mounted latch 43.

Note that the hinge 44 on the front corner inner case unit 31 is recessed to allow door to be recessed in side of and in front of inner case unit On the top of the inner case is a fixed nut 45 for a second safety bolt.

As shown in FIG. 6, the removable drawers 35 have a recessed handle 46 in the tray front and an identical handle in the back.

A top handle 47 is attached to the top of each tray 35 as shown.

Note that the inner housing 31 has three fixed trays 48. These trays are fixed and used in the same manner as those of the regular unit.

Operation of this unit is identical to that of the regular unit. The only difference is that the handles 33 are designed as shown compared to the handles in the regular unit.

The Open Top Unit

Figure 7:
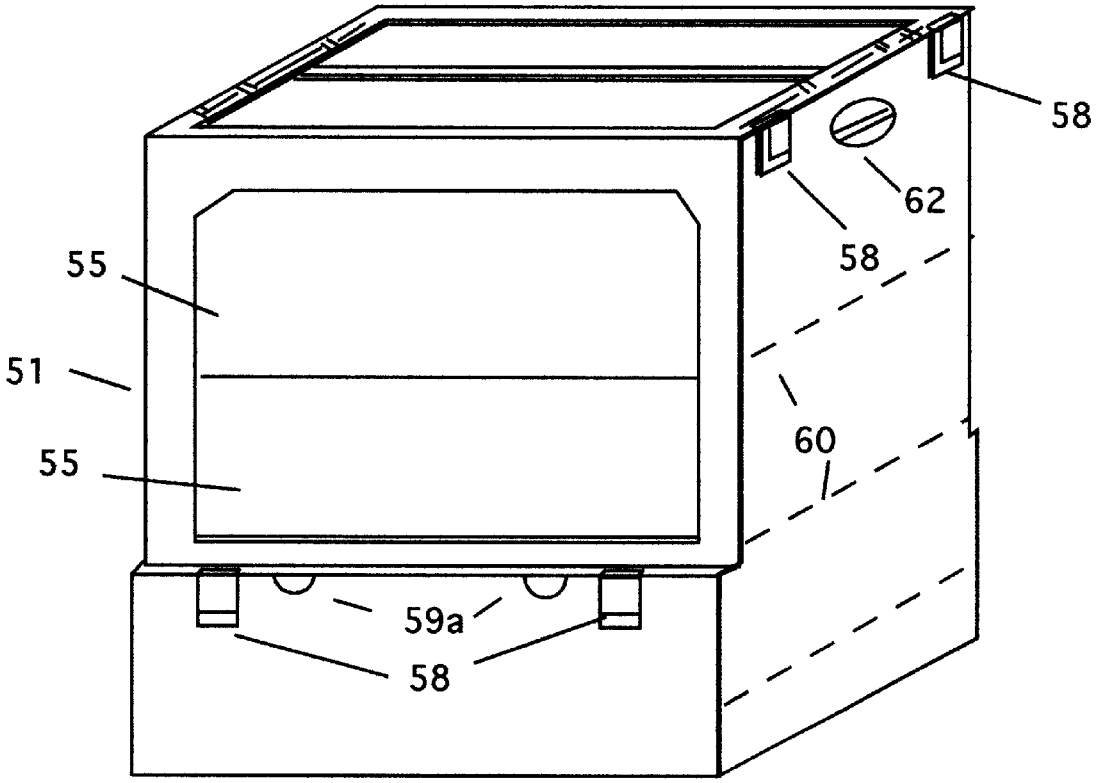
FIG. 7 shows a perspective view of the outer housing of the design, called the open top unit.
Figure 8:
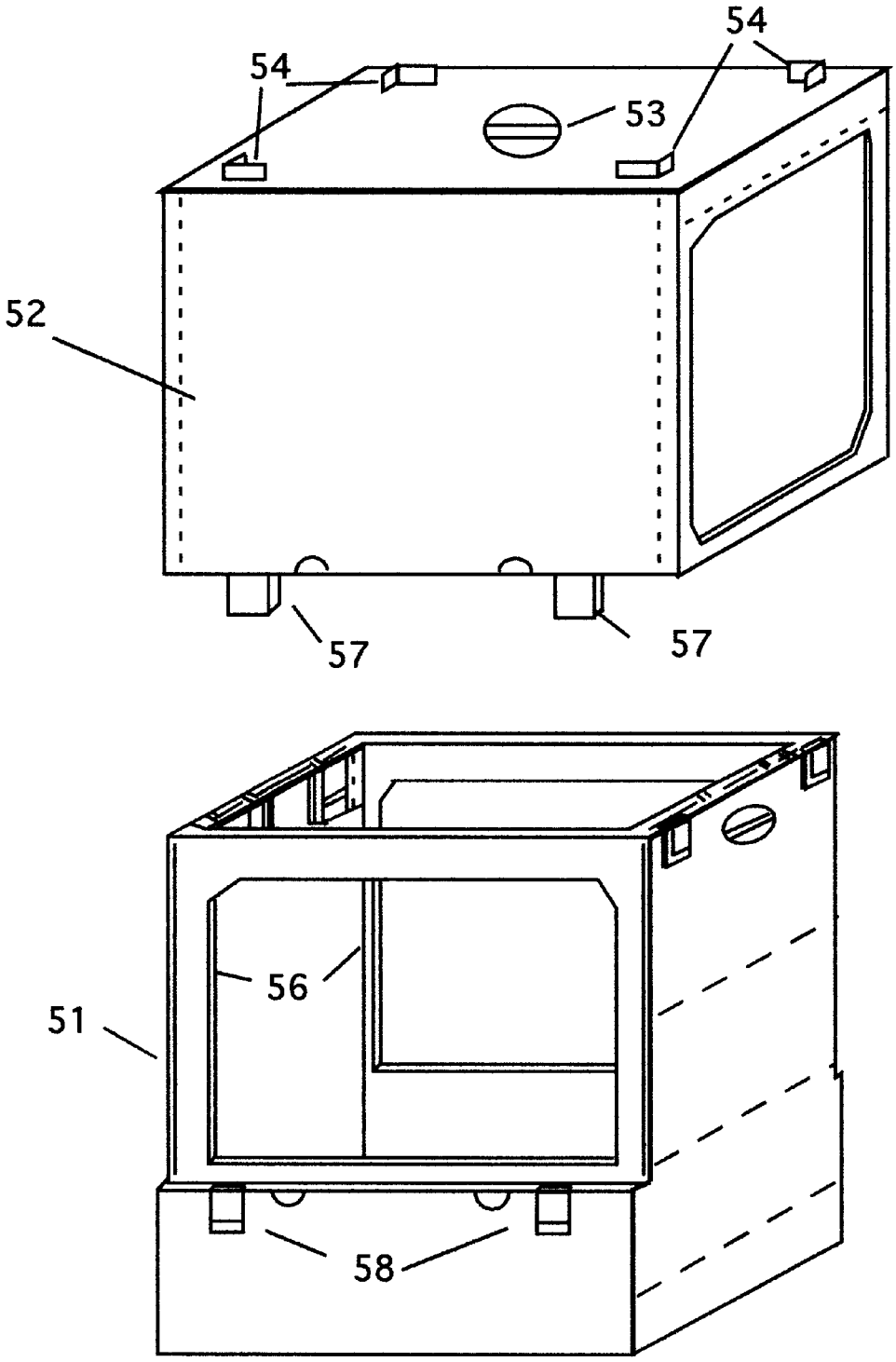
FIG. 8 Shows a perspective view of the open top unit opened
Figure 9:
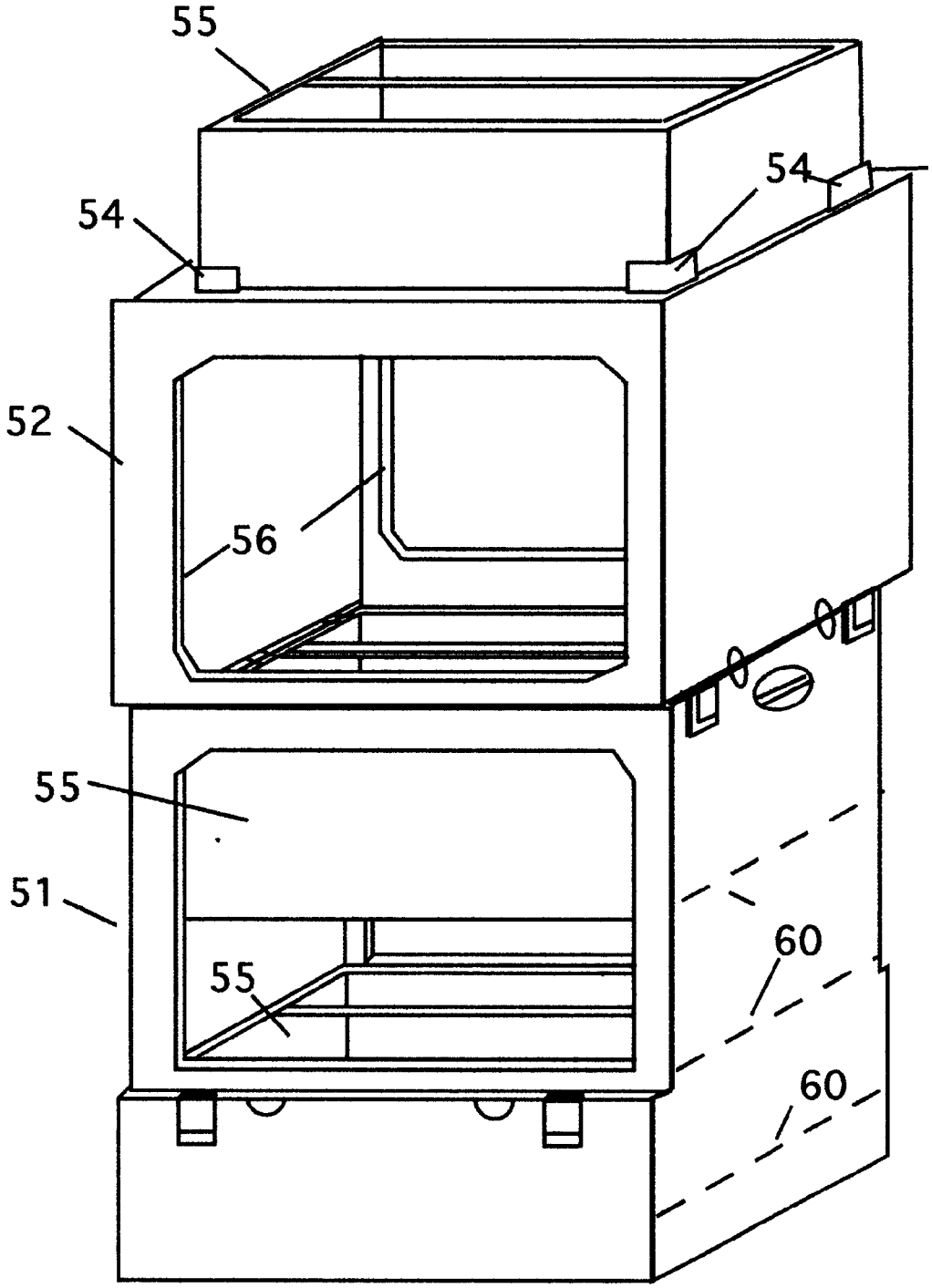
FIG. 9 is a perspective view of the open unit with the top rotated and secured to the base, ready for use.

Referring now to FIGS. 7, 8, and 9, details of the open top unit 50 are shown. FIG. 7 shows the inner case 51 with the trays 55 loaded, but the outer case 52 removed.

Referring now to FIG. 8, in this unit, the inner case 51 has an open top. The outer case 52 has a solid top that has a center handle 53. Four corners 54 are shown on the top of the unit. Like the previous units, these corners hold one of the removable trays 55 when the case is opened. See FIG. 9.

This unit also has a ½" lip 56 is provided for weather-proofing. This weather proofing system is identical to that of the regular unit.

On the bottom of the outer housing are 4 pegs 57 that connect the outer housing to the inner case for storage and use. Slots 58 are placed in the inner housing as shown, to receive the pegs. Also as on the regular unit, adjacent to the pegs 57 is a set of upper buckles 59 used to secure the outer housing to the inner case. Lower buckles 59*a* are provided as on the regular unit.

Referring now to FIG. 9, the inner case has rails 60. The rails support the trays when the unit is both opened and closed.

As shown in FIG. 9, at the bottom of the inner case is one tray 55 inner case. Above that is a second tray 55. Above that is a third tray 55.

Two handles 62 are recessed into inner case wall flush with outside surface as shown.

To open this unit for use, follow these steps:

1. Unbuckle bottom of the outer housing from the bottom of the inner case.
2. Lift the outer housing off the outer housing unit and place it aside from the inner case and onto the floor.
3. Lift the top two trays out of the inner case and place them onto the floor.
4. Replace one tray and place it on the top rails of the inner case.
5. Place the bottom of the outer housing on the top of the inner case (orientation of the outer housing is 90 degrees from closed position).
6. Attach buckles on the bottom of the outer housing to the top of the inner case.
7. Move the remaining tray from the floor to the top of the outer housing.

This is now the configuration shown in FIG. 9

8. Reverse process to close unit.

Note that this unit does not have any fixed shelves.

The U Top Unit

Figure 10:
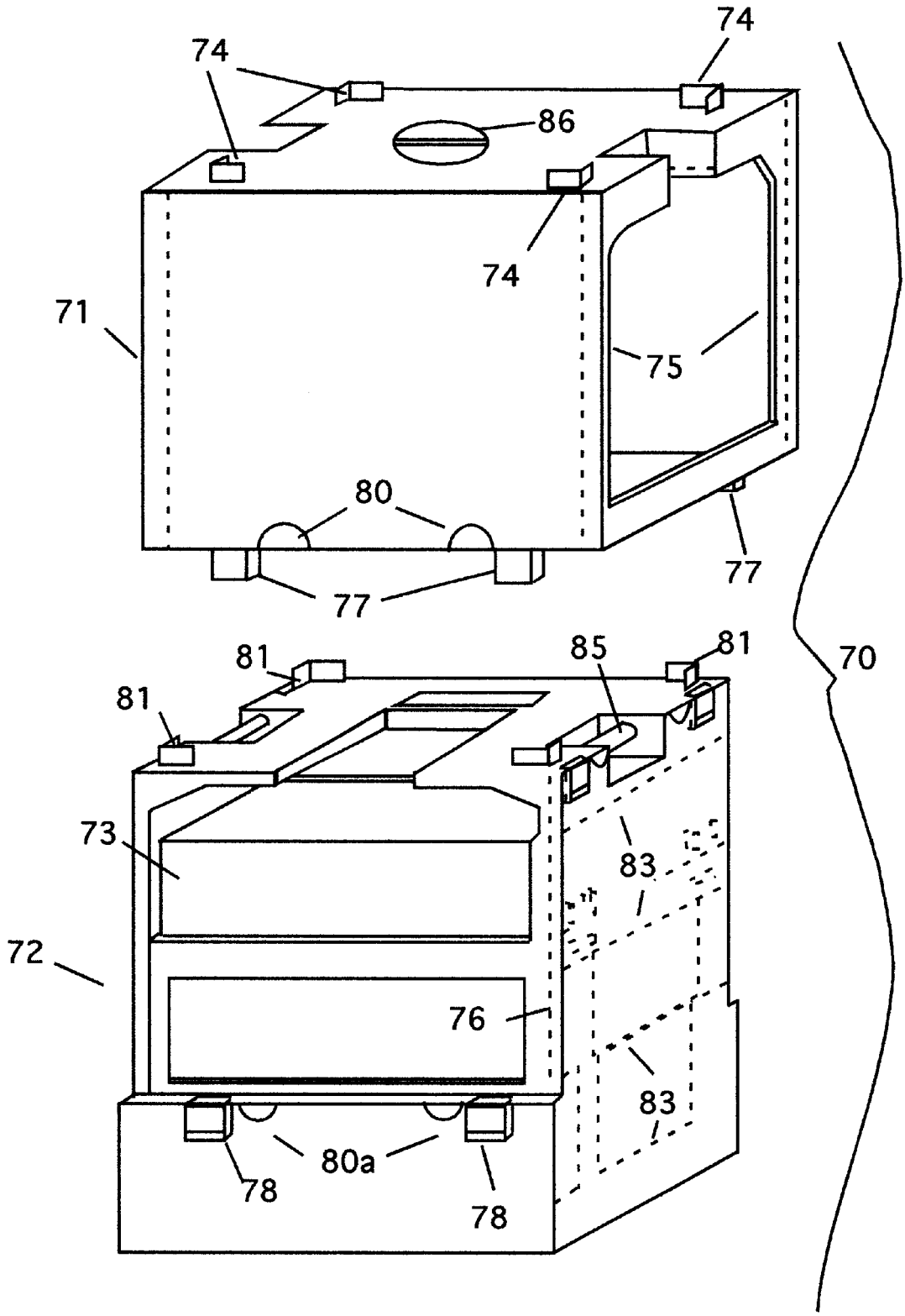
FIG. 10 shows a perspective view of the "U" top unit opened.
Figure 11:
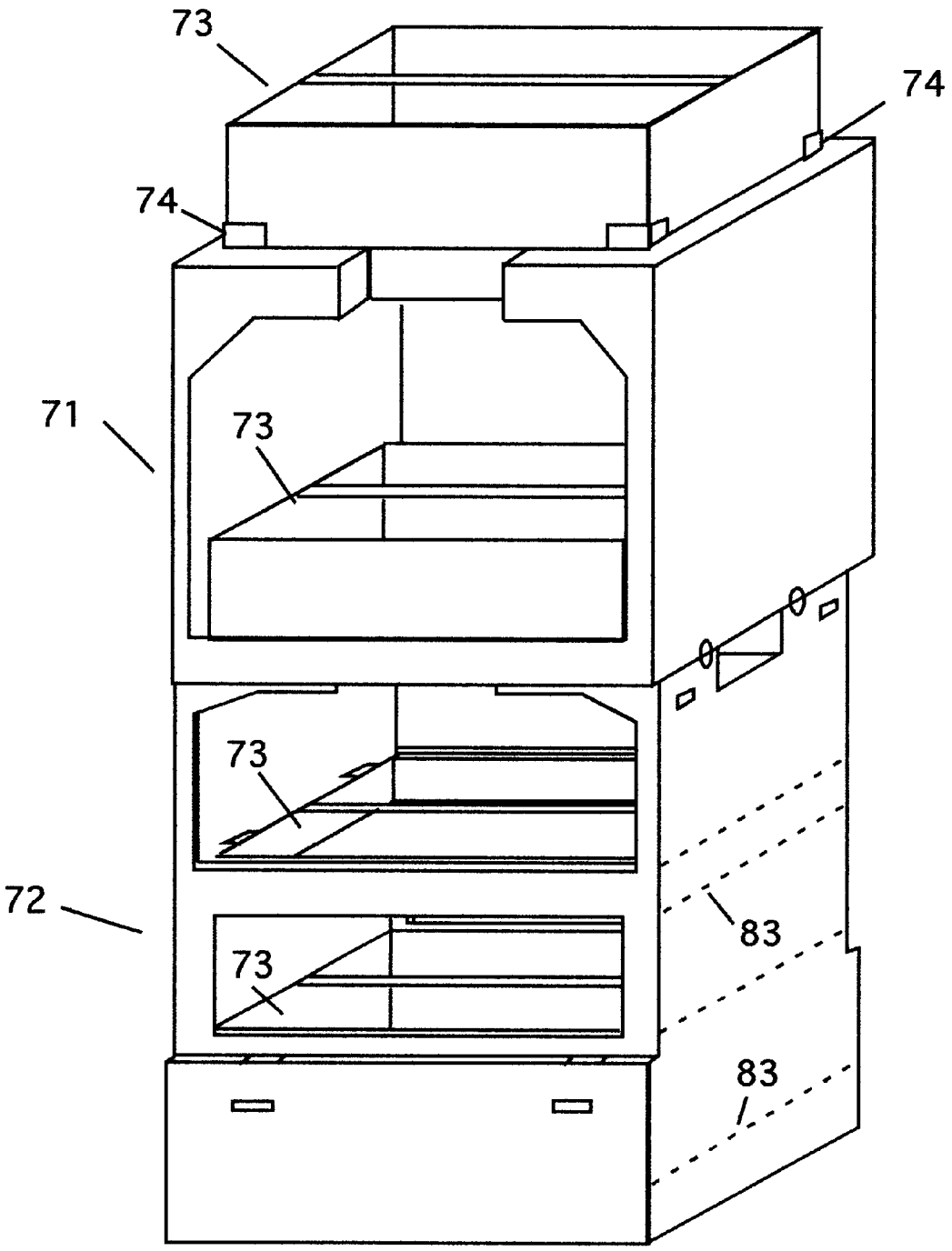
FIG. 11 is a perspective view of the "U" top unit with the top rotated and secured to the base, ready for use.

FIGS. 10 and 11 show details of the U top unit 70.

FIG. 10 shows the outer housing 71. Removed from the inner case 72. In this view four trays 73 are shown in place within the inner case 72.

The outer housing 71 has closed sides, an open front and back as shown. In this view, the outer housing has been lifted off the inner case, but it has not been turned.

Note that like the other units, the top of this unit has four corners 74 that hold the bottom of the top tray 73 when the unit is in the open position. Below the top surface is a ½" weather lip-over lap 75 that fits over the inner case. The inner case also has a lip 76 to fit groove 75 in outer housing when the unit is in the closed position. This is the same feature as discussed above for the other units.

Also at the bottom of the unit are a set of pegs 77 that interlock the outer housing and the inner case. The inner case also has a set of sockets 78 to receive the pegs 77 from the outer housing when the unit is in the closed position. Again, these features are identical to those of the other units discussed above.

Next to the pegs 77 are the top halves 80 of a number of buckles that are used to close the box. The inner case also has a set of buckles 80*a* corresponding to the buckles 80 in the outer housing. At the top of the inner case are a number of buckle bottom halves 80*b* that attach to the outer housing in the open position. This again is like the embodiments mentioned above.

Referring now to FIG. 10, at the top of the inner case are four corners 81 that hold the bottom of a second tray when the unit is in the open position. See FIG. 11.

As mentioned above, in FIG. 10, the inner case has four trays 73 installed.

To hold the trays in the open position, the inner case has rails 83 installed as shown. The trays placed on the rails may have stops placed on them as mentioned above.

Also as shown, the inner case also has a pair of handles 85 as shown. A handle 86 is also installed in the center of the outer case case.

FIG. 11 shows the unit opened with the e trays installed. Note how the uppermost trays fit into the corners on the tops of the inner and outer housing.

To open the U Top Unit perform the following steps:

1. Unlatch the buckles that connect the bottom of the outer housing to the bottom of the inner case.
2. Lift the outer housing above the inner case.

This point is illustrated in FIG. 10.

3. Place the outer housing aside from the inner case on the floor.
4. Move the top three trays up and out of the front of the inner case and on to the floor.
5. Put a tray back into its position in the inner case above the bottom tray.
6. Rotate the outer housing 90 degrees from its closed position and put the bottom of the outer housing on the top of the inner case.
7. Attach buckles on the bottom of the outer housing to the top of the inner case.
8. Put a third tray on top of the outer housing (orientation the same as it was in the inner case).
9. Put the last tray inside the outer housing and on top of the inner case (orientation the same as it was in the inner case).
10. Reverse the process to close the unit.

This is the configuration shown in FIG. 11.

Note that in this embodiment, the trays have handles 88 across the tops of the trays as shown.

Vertically Rising Rack Unit

Figure 12:
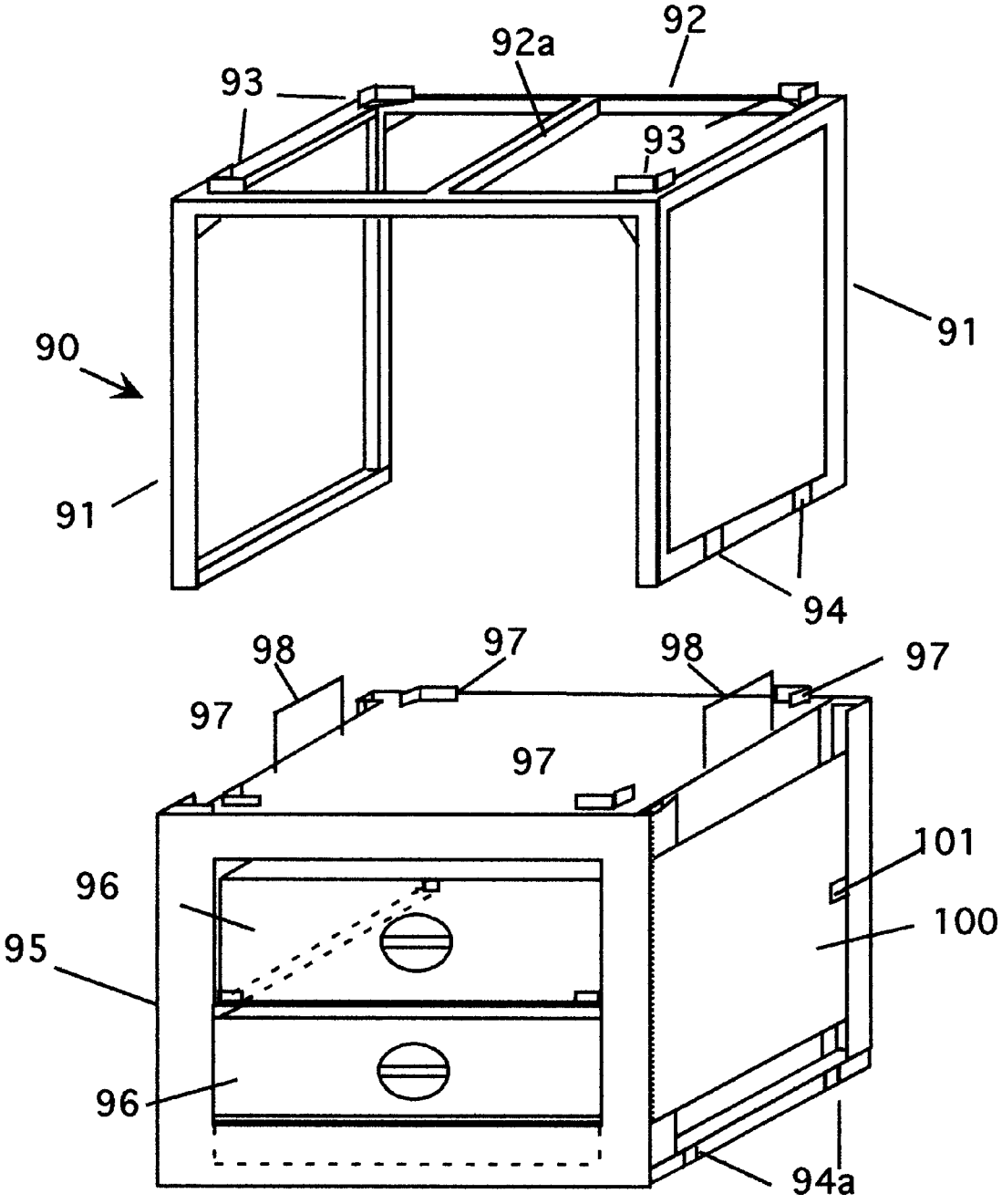
FIG. 12 shows a perspective view of the vertical lift rack unit opened.
Figure 13:
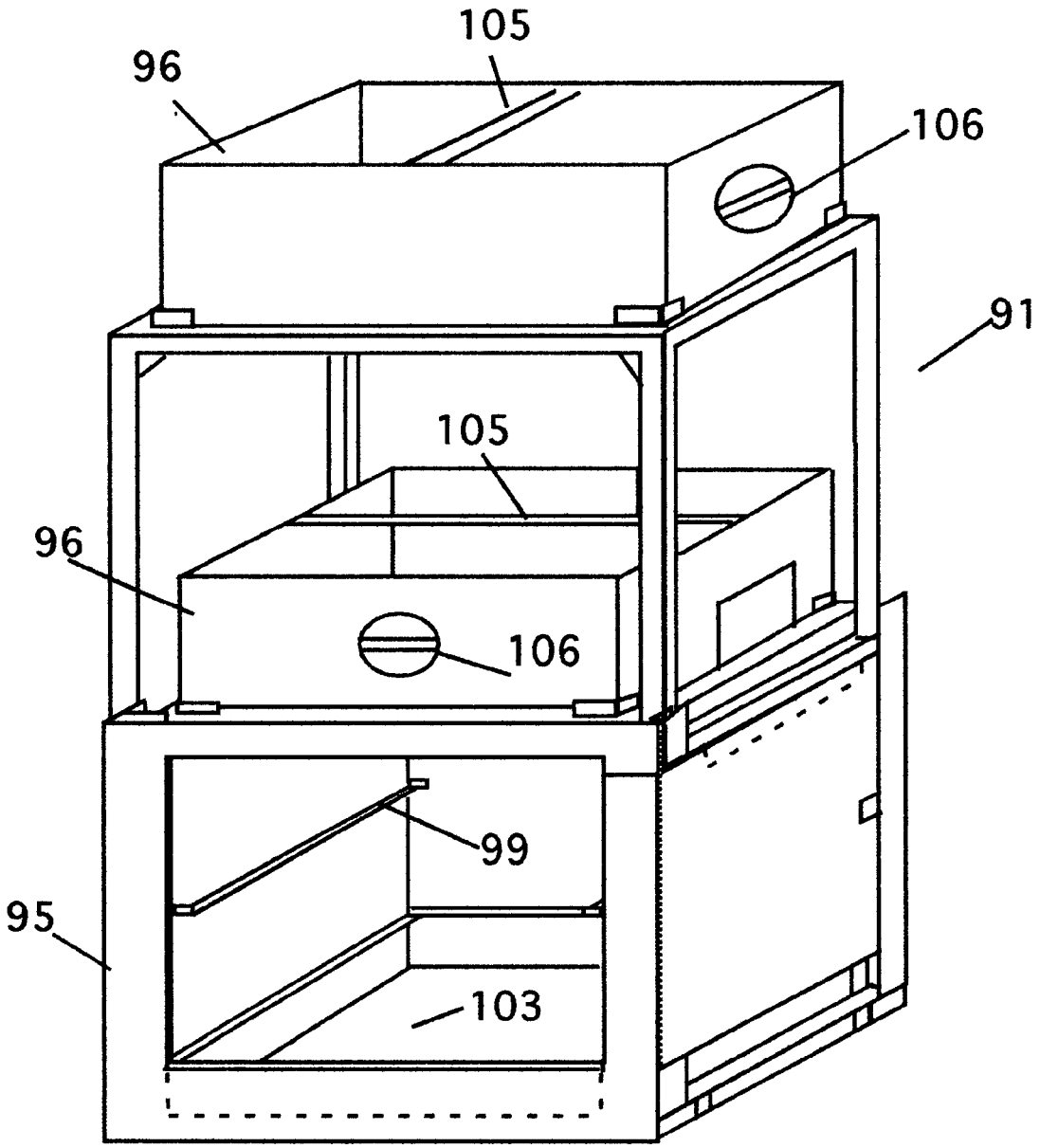
FIG. 13 is a perspective view of the "U" top unit with the top secured to the base, ready for use.

FIGS. 12 and 13 illustrate a smaller version of the toolbox that holds two removable storage trays and has one fixed tray. In this embodiment, the outer housing is a rack 90. The rack 90 has two side frames 91 and a top frame 92 as shown. Note that the center rail 92*a* on the rack top can be used as handle in raising and lowering rack. On the top frame are four corners 93 that, as in other embodiments, support one tray. On the bottom of the side frames 91 are the top half of buckles 94 for securing the rack when it is in the lowered or closed position.

FIG. 12 also shows the inner case 95. This case has an open interior that holds two trays 96. The top of the inner case also has four corners 97 for supporting a tray when in the open position. The top of the inner case also has a pair of handles 98 for carrying the unit.

On the sides of the inner case are four vertical rails 99 in which rack rides when the unit is closed. On one side of the inner case is a door 100. FIGS. 12 and 13 shows the latch 101 for door. Note that in the preferred embodiment, the door swings 270 degrees to close over front of base unit.

The inner case also has the bottom half 94*a* of buckles 94 for securing rack in lowered position.

FIG. 13 shows the unit in the open position. Here, the support rails 102 for the trays are shown. These rails can have stops to prevent the trays from sliding out of the inner case, if desired.

The inner case has one fixed tray 103 built into base of the inner case as shown. Two removable trays 96 are shown in place ready for use. As before, these trays 96 have center handles 105 and pulls 106.

The rack has spring-loaded clips (not shown) that are used to allow the rack to slide up from the inner case. This feature is discussed below.

To Open the vertically rising rack unit, the following procedure is used:

1) raise the rack until the rack supports (spring-loaded clips) open under rack bottom.
2) Open doors, swing doors 270 degrees.
3) Move one tray to the top of the base unit.
4) Move the second tray to the top of the rack. Note that in one embodiment, The upper tray must be rotated horizontally 90 degrees to fit in the support corners at the top or the rack.

To Close the vertically rising rack unit, the reverse procedure is used except that in the final step, to lower the rack, depress spring loaded rack clips to allow the rack to descend.

The final embodiment is called the flip top unit. This unit is different from the others because the outer case has only two sides and a bottom. The trays are designed to stack independent of the cases, so no rails or corners are needed. This unit has a lower container and a lid.

Figure 14:
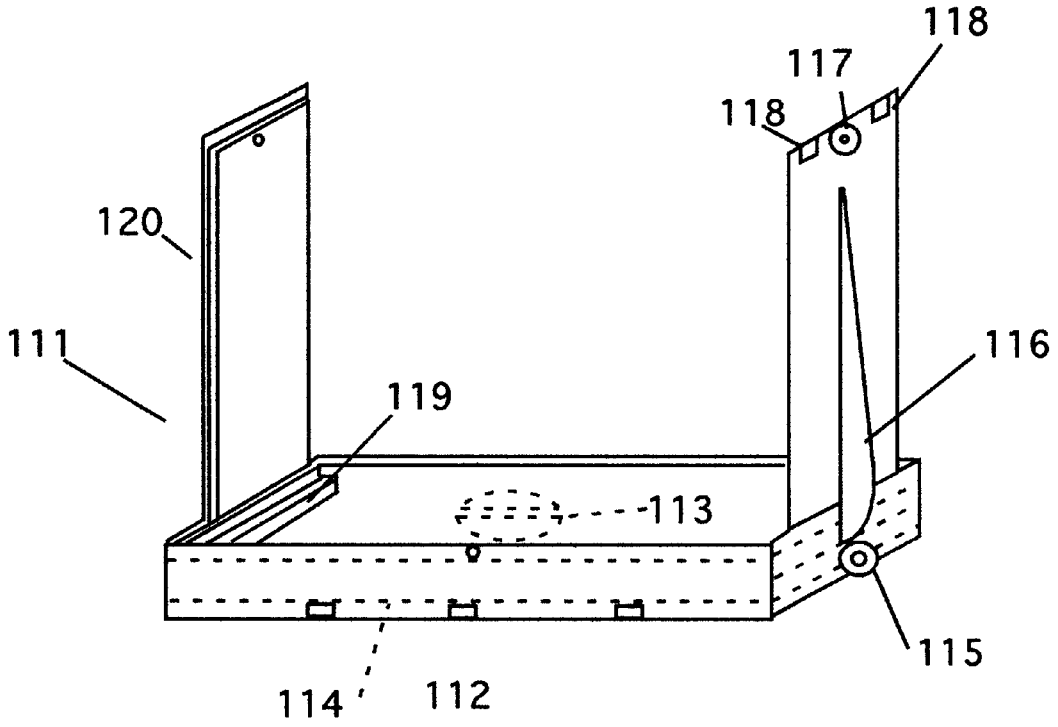
FIG. 14 shows a perspective view of the "flip top" unit opened.
Figure 14:
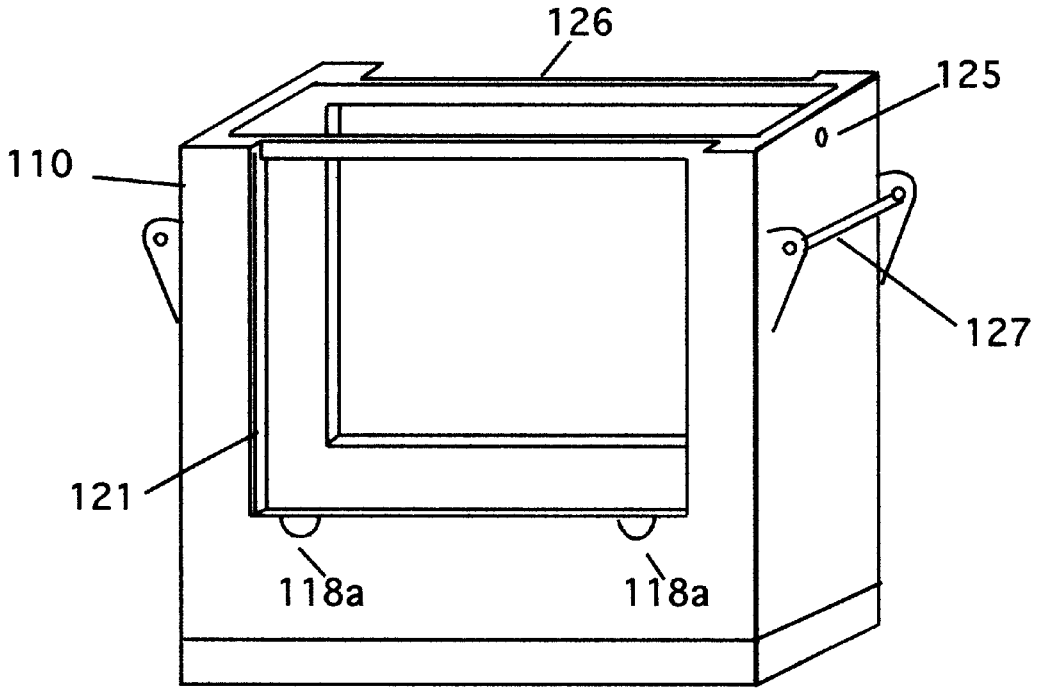

FIG. 14 shows details of the container 110 and the lid 111. The lid 111 is designed to close the unit weather tight. The lid 111 has holes 112 for water drainage.

The lid has a handle 113 in a depression 114 in the lid. The handle is designed to be flush with top surface of lid in the closed position.

The lid 111 has two large head locking bolts 115 that are used to secure the lid to the container. In the preferred embodiment, these bolts are hand-tightened.

Stiffeners 116 are used to hold shape of vertical panels of the lid.

At the bottom of the lid (the top when it is flipped) are two additional large head locking bolts 117, which are used to control vertical and horizontal movement of stacked trays when the unit is open.

Also located on the bottom of the lid 111 are the top half of buckles 118 to fasten down lid to base-closed position.

The inside top of the lid has cleats 119 to position the lower tray of the upper tray set when the unit is in the open position.

The lid also has a set of grooves 120 that fit a lip 121 in vertical sides of cabinet openings.

FIG. 14 also shows details of the base container 110. Note that the base-may be fitted with 4 wheels (not shown) if desired.

At the top of the container are two fixed nuts 125 fixed in place that receive the locking bolts 115 that hold the lid in the closed and open positions, as discussed below.

At the top of the container 110 is a collar 126. The container also has two handles 127 as shown.

The base of the container has the lower half 118*a* of buckles 118 to latch lid to base.

Figure 15:
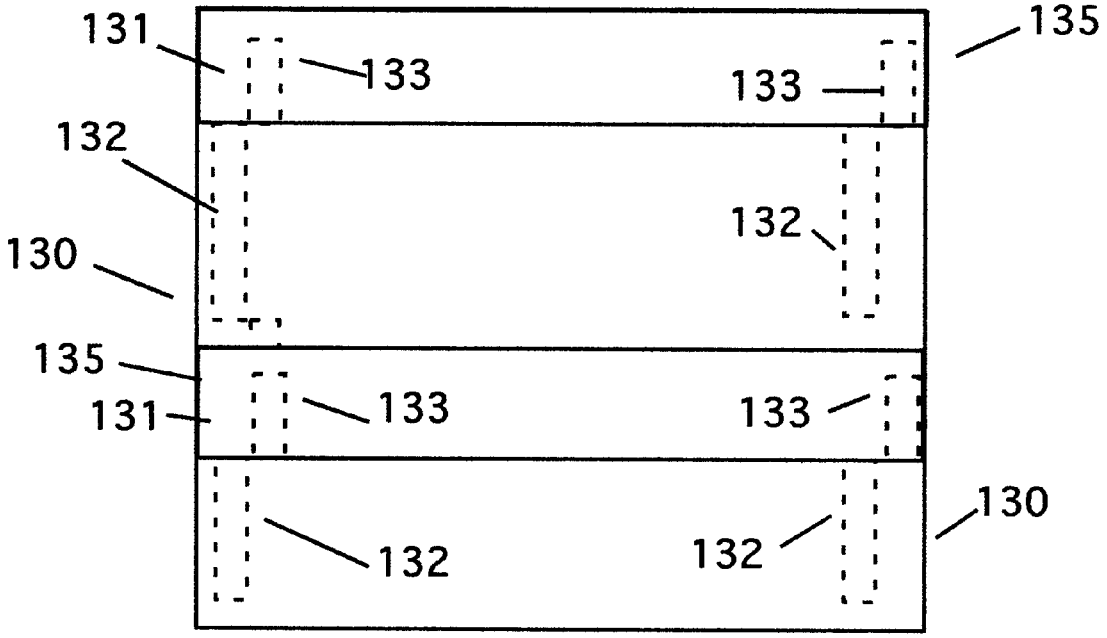
FIG. 15 is a front view of the storage strays for the flip top unit stacked in the closed position.
Figure 16:
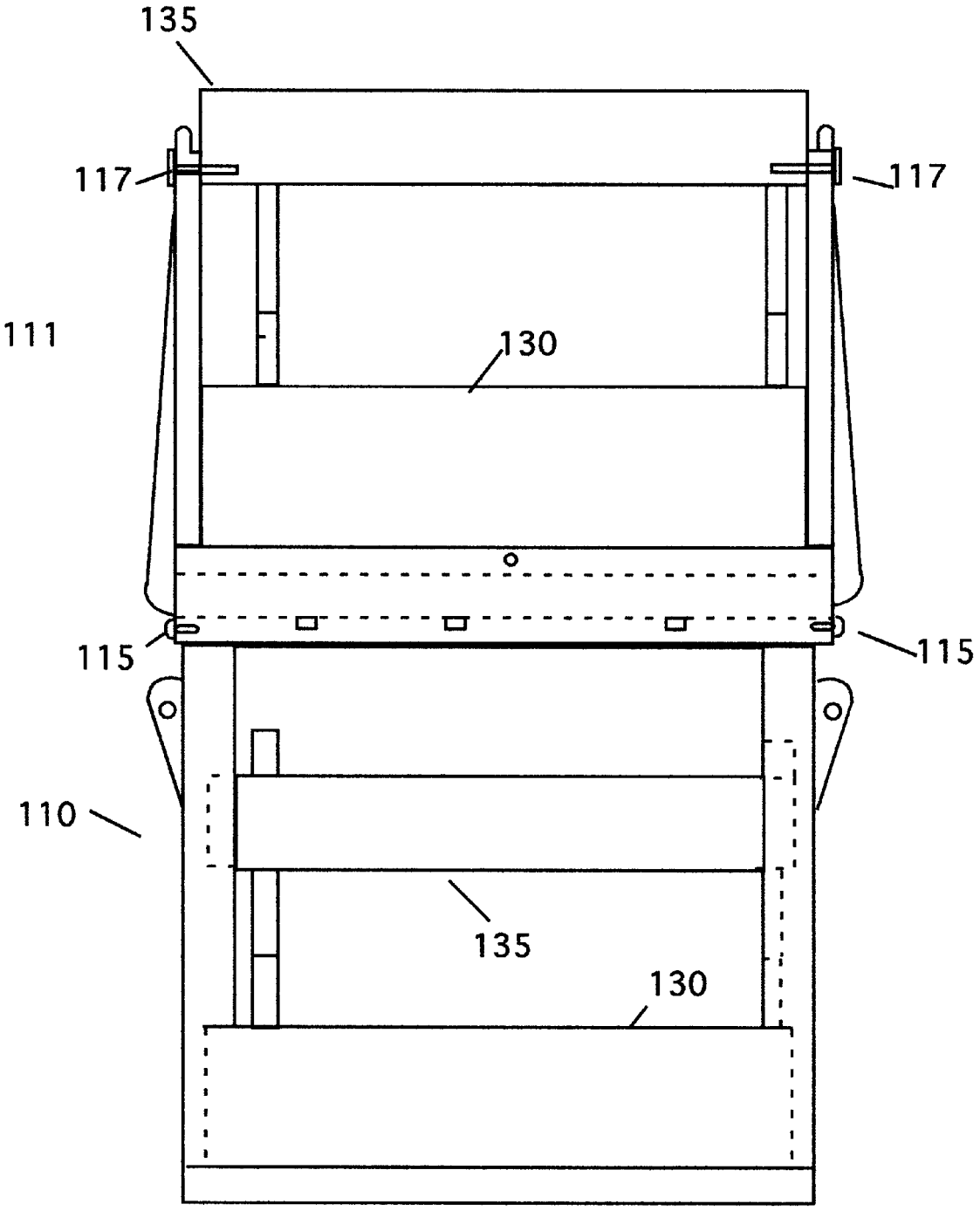
FIG. 16 is a front view of the "flip top" unit with the top set in place and the trays installed, ready for use.

Referring now to FIGS. 15 and 16, details of the stacking tray set are shown. This unit has four stacking trays. In trays 130 there are pockets 131 that receive the down leg 132 of tray above. These pockets run the length the tray. Next to the pockets 131 are the up legs 133 from top of tray.

Pockets 131 and up legs 133 are located on both sides of the trays 130.

Two trays 135 are also provided. These trays have a similar set of pockets and legs on them as shown.

FIG. 15 shows the trays in the closed position. Here, the down legs of trays 135 are shown fitting into the trays below them.

FIG. 16 shows the four trays in the open position with flip lid and base set In place. This figure shows how the down legs of the trays fit together with the up legs on the trays to from a two tray unit (it is possible to stack all four trays together independent of the lid and container, but this is not shown). In the figure there are two sets of stacked trays. One set is placed in the container as shown.

The FIGURE also shows the locking bolts 117 that are used to hold top tray set in place in the lid. These bolts control vertical and horizontal movement of the trays when in the lid.

FIG. 16 also shows the lid flipped over and rotated 90 degrees from its stored position.

When flipped locking bolts 115 and buckles 118 are used to secure the lid to the container.

To open the unit, first, the user slides the lid 111 from the container, after undoing the locking bolts and buckles. Next, the four trays are removed form the inside of the container. Two of the trays are assembled in the open stacked position and put back into the container. Next, the lid is flipped over and rotated 90 degrees and placed on the top of the container. Locking bolts are then used to secure the lid to the container. Next, the remaining trays are assembled into a stacked unit and are placed on the lid. Locking bolts 117 are used to secure these trays in place as shown.

The unit is then ready to use. To close the unit, follow the reverse procedure.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A portable toolbox comprising:

a) an inner case having an open interior;

b) an outer case, also having an open interior and being configured to fit over said inner case when said portable toolbox is closed;

c) a plurality of removable storage trays, removably installed in said inner case;

d) whereby said portable tool box having a closed configuration wherein said plurality of removable storage trays are stored within the open interior of said inner case and said outer case is covering said inner case;

e) whereby said portable tool box having an open configuration whereby said outer case is positioned above said inner case and said plurality of removable storage trays is distributed between said inner case as said outer case;

f) a means for securing said outer case to said inner case when said portable tool box is in said closed configuration; and g) a means for securing said outer case to said inner case when said portable toolbox is in said open configuration.

2. The portable toolbox of claim 1 further comprising at least one fixed tray, installed in said inner case.

3. The portable toolbox of claim 1 further comprising a plurality of fixed trays, installed in said inner case.

4. The portable toolbox of claim 3 wherein the plurality of fixed trays support said plurality of removable storage trays.

5. The portable toolbox of claim 1 wherein the means for securing said outer case to said inner case when said portable tool box is in said closed configuration comprise at least one post, attached to said outer case and at least one socket formed in said inner case, whereby said post and said socket are positioned to be lockably engaged when said outer case and said inner case are in the closed configuration.

6. The portable toolbox of claim 1 wherein the means for securing said outer case to said inner case when said portable tool box is in said open configuration comprise at least one post, attached to said outer case and at least one socket formed in said inner case, whereby said post and said socket are positioned to be lockably engaged when said outer case and said inner case are in the open configuration.

7. The portable toolbox of claim 1 further comprising a door, hingably attached to said inner case.

8. The portable toolbox of claim 1 further comprising a pair of handles, attached to said inner case.

9. The portable toolbox of claim 1 wherein the outer case is an open rack.

10. The portable toolbox of claim 1 wherein each of said plurality of storage trays has a handle attached thereto.

11. The portable toolbox of claim 1 wherein the inner case as a plurality of support rails attached to the open interior of said inner case for supporting said plurality of removable storage trays.

12. The portable toolbox of claim 1 wherein the inner case and the outer case each have a plurality of corner supports for holding one of said plurality of removable storage trays when said portable toolbox is in the open configuration.

13. A portable toolbox comprising:

a) an inner case having an open interior, a top, wherein said top has a plurality of corner supports attached thereto;

b) an outer case, also having an open interior and being configured to fit over said inner case when said portable tool box is closed, said outer case also having a top and also having corner supports attached thereto;

c) a plurality of removable storage trays, removably installed in said inner case;

d) a plurality of fixed trays, installed in said inner case;

d) whereby said portable tool box having a closed configuration wherein said plurality of removable storage trays are stored within the open interior of said inner case and said outer case is covering said inner case;

e) whereby said portable tool box having an open configuration whereby said outer case is positioned above said inner case and said plurality of removable storage trays is distributed between said inner case as said outer case;

f) at least one post, attached to said outer case and at least one socket formed in said inner case, whereby said post and said socket are positioned to be lockably engaged when said outer case and said inner case are in the closed configuration; and g) at least one socket formed in said inner case, whereby said post and said socket are positioned to be lockably engaged when said outer case and said inner case are in the open configuration.

14. The portable toolbox of claim 13 further comprising a door, hingably attached to said inner case.

15. The portable toolbox of claim 13 further comprising a pair of handles, attached to said inner case.

16. The portable toolbox of claim 13 wherein each of said plurality of storage trays has a handle attached thereto.

17. The portable toolbox of claim 13 wherein the inner case as a plurality of support rails attached to the open interior of said inner case for supporting said plurality of removable storage trays.

18. The method of use of a portable tool box having:

a) an inner case having an open interior, a top, wherein said top has a plurality of corner supports attached thereto;

b) an outer case, also having an open interior and being configured to fit over said inner case when said portable tool box is closed, said outer case also having a top and also having corner supports attached thereto;

c) a plurality of removable storage trays, removably installed in said inner case;

d) a plurality of fixed trays, installed in said inner case;

d) whereby said portable tool box having a closed configuration wherein said plurality of removable storage trays are stored within the open interior of said inner case and said outer case is covering said inner case;

e) whereby said portable tool box having an open configuration whereby said outer case is positioned above said inner case and said plurality of removable storage trays is distributed between said inner case as said outer case;

f)at least one post, attached to said outer case and at least one socket formed in said inner case, whereby said post and said socket are positioned to be lockably engaged when said outer case and said inner case are in the closed configuration; and g) at least one socket formed in said inner case, whereby said post and said socket are positioned to be lockably engaged when said outer case and said inner case are in the open configuration; comprising the steps of:

a) removing the outer case from said inner case;

b) removing at least one of said plurality of removable storage trays;

c) placing the outer case on top of said inner case;

d) securing said outer case to said inner case; and e) placing the at least one of said plurality of removable storage trays on the top of said outer case, thereby forming said open configuration of said portable tool box.

19. The method of claim 18 wherein the step of removing at least one of said plurality of removable storage trays further comprises removing an additional removable storage tray from said inner case.

20. The method of claim 19 further comprising the steps of:

a) placing the additional removable storage tray from said inner case on the top of said inner case;

b) removing another of said plurality of removable storage trays from said inner case; and c) replacing the another of said plurality of removable storage trays into said inner case in a spaced apart relationship from the remainder of said plurality of removable storage trays in said inner case.

* * * * *